US006298990B1

(12) United States Patent
Amrod et al.

(10) Patent No.: US 6,298,990 B1
(45) Date of Patent: Oct. 9, 2001

(54) CONTAINER WITH SOUND CHIP

(75) Inventors: Barbara J. Amrod, Ridgefield, CT (US); John A. Bardwell, Bethel; Kenneth R. Thayer, Danbury, both of CT (US); Susan M. Seamon, Sleepy Hollow, NY (US); Jeffrey S. Gibb, Boonton, NJ (US); Barbara M. Smith, Forest Hills, NY (US); Dexter R. Below, Wilton, CT (US)

(73) Assignees: Kraft Foods Holdings, Inc., Northfield, IL (US); Graphic Packaging Corporation, Golden, CO (US)

( * ) Notice: Subject to any disclaimer, the term of this patent is extended or adjusted under 35 U.S.C. 154(b) by 0 days.

(21) Appl. No.: 09/656,319

(22) Filed: Sep. 6, 2000

(51) Int. Cl.[7] ..... B69D 85/00
(52) U.S. Cl. ..... 206/459.1; 206/457; 340/540
(58) Field of Search ..... 206/457, 459.1, 206/232; 340/540, 546, 555, 692, 384.1, 384.3

(56) References Cited

U.S. PATENT DOCUMENTS

| | | | | |
|---|---|---|---|---|
| 3,811,532 | * | 5/1974 | Everittr | 181/156 I |
| 4,242,670 | | 12/1980 | Smith . | |
| 4,255,745 | | 3/1981 | Rohan et al. . | |
| 4,607,747 | | 8/1986 | Steiner . | |
| 4,617,556 | | 10/1986 | Rivera et al. . | |
| 4,688,023 | | 8/1987 | McGill et al. . | |
| 4,911,320 | | 3/1990 | Howes . | |
| 5,056,659 | | 10/1991 | Howes et al. . | |
| 5,063,698 | * | 11/1991 | Johnson et al. | 40/124.1 |
| 5,099,232 | | 3/1992 | Howes . | |
| 5,130,696 | | 7/1992 | Liebman . | |
| 5,275,285 | * | 1/1994 | Clegg | 206/449 |
| 5,281,952 | | 1/1994 | Dragan . | |
| 5,283,567 | | 2/1994 | Howes . | |
| 5,289,917 | * | 3/1994 | Chabria | 206/232 |
| 5,379,886 | | 1/1995 | Brauner et al. . | |
| 5,439,103 | | 8/1995 | Howes . | |
| 5,464,092 | | 11/1995 | Seeley . | |
| 5,577,918 | * | 11/1996 | Crowell | 434/319 |
| 5,710,422 | * | 1/1998 | Clark | 340/384.1 |
| 5,728,415 | | 3/1998 | Troska . | |
| 5,761,836 | * | 6/1998 | Dawson | 40/124.03 |
| 5,762,194 | * | 6/1998 | Clegg | 206/449 |
| 5,796,328 | | 8/1998 | Golant . | |
| 5,806,707 | | 9/1998 | Boehm et al. . | |
| 5,819,976 | | 10/1998 | Boehm et al. . | |
| 5,886,621 | * | 3/1999 | Clark | 340/384.1 |
| 5,894,275 | | 4/1999 | Swingle . | |
| 5,903,869 | * | 5/1999 | Jacobson et al. | 434/319 |
| 5,923,242 | | 7/1999 | Slagle et al. . | |
| 5,939,983 | | 8/1999 | Rudell . | |
| 5,971,195 | | 10/1999 | Reidinger et al. . | |
| 5,992,629 | | 11/1999 | Gullord et al. . | |
| 6,032,820 | | 3/2000 | Ladina et al. . | |
| 6,056,116 | | 5/2000 | Troska . | |
| 6,104,306 | * | 8/2000 | Hogue et al. | 340/686.1 |

* cited by examiner

*Primary Examiner*—Shian Luong
(74) *Attorney, Agent, or Firm*—Thomas A. Marcoux

(57) ABSTRACT

A container that includes a sound assembly mounted thereon. The sound assembly includes a sound chip activated by a light sensor. An opening is cut into the container for receiving the sound chip which is mounted on a mounting member. The mounting member, in turn, is sealed to the container such that the opening is completely closed and the mounting member is substantially visually indistinguishable from the exterior of the container. The sound assembly is preferably mounted near the end of the container designed to be opened such that it is activated immediately upon opening the container.

21 Claims, 5 Drawing Sheets

CONTAINER WITH SOUND CHIP

FIELD OF THE INVENTION

The present invention relates to a container for promotional sale of a product and, more particularly, to a container for a product wherein a sound chip is activated by exposure to light when the container is opened and a method for the manufacture thereof.

BACKGROUND OF THE INVENTION

It is well known to utilize various types of promotional devices to increase sales of packaged foods. One of the more common ways of promoting a product is to indicate on the exterior of the product container that a prize is included inside the container.

Another type of promotional device is the use of game pieces or other objects which may be attached to the side of the container. Brauner et al, U.S. Pat. No. 5,379,886, for example, discloses inserting a separately formed tray into the side wall of a container. A promotional device is positioned in the tray which is then sealed by a label. Still another way of promoting a product is with a container having a light-activated sound chip. Howes, U.S. Pat. No. 5,283,567, for example, discloses a prize holding container assembly with an audible and/or visual prize related message delivery system contained within the container. In the Howes device, the message delivery system is placed within the contents of the container such that the message is not delivered until the consumer actually locates the message delivery system. Alternatively, Howes, U.S. Pat. No. 5,099,232, discloses mounting the message delivery system on the interior wall of the container. A drawback of this embodiment is that the container requires significant modification in order to mount the message delivery system. Similarly, Slagle et al, U.S. Pat. No. 5,923,242, discloses a light-activated, sound-providing device which is secured to the interior of a container. Mounting of such a device is fairly complex.

However, retooling to create a new package configuration or even for modification of a conventional package can be costly. In this regard, it is desirable that the promotional device be one which requires a minimal amount of changes in the process of manufacturing the container.

SUMMARY OF THE INVENTION

Thus, it is a purpose of the present invention to overcome the disadvantages of the prior art and thereby provide an improved container for promotional sale of a product and an improved method for the manufacture thereof.

This purpose of the present invention is achieved by providing a light activated sound assembly which is mounted on the interior of the container, through an opening in the side of the container, which opening is subsequently closed. The sound assembly is thereby positioned such that light activates the sound chip upon opening of the container.

In accordance with a preferred embodiment of the invention, the container for promotional sale of a product includes a sound assembly comprising a mounting member having an inner surface and an outer surface and a sound chip mounted on the inner surface of the mounting member.

The container is modified by forming an opening in a wall. The opening has dimensions such that the mounting member is capable of completely covering the opening and the sound chip is insertable through the opening when mounted on the mounting member. The sound assembly is mounted on the container such that the sound chip is positioned in the interior of the container and the inner surface of the mounting member is adjacent to the exterior surface of the container. The mounting member is secured to the exterior surface.

In accordance with a preferred method of manufacturing a container for use in promotional sale of a product, a sound chip is mounted on a mounting member and an opening is created in a wall of either a blank used to form a container or in the assembled container itself. The opening has dimensions such that the mounting member is capable of completely covering the opening and a sound chip, mounted on the mounting member, is insertable through the opening such that it extends inwardly from the interior surface of the blank or package. The mounting member is then secured to the exterior surface of the blank or container such that the opening is completely covered.

It is therefore an object of the present invention to provide a container for promotional sale of a product which utilizes a conventional container requiring only a minor modification thereto.

It is another object of the invention to provide a container for promotional sale of a product and a method of manufacture therefor wherein a conventional container is modified by mounting a sound chip through an opening in a side wall thereof.

These and further objects of the present invention will become apparent from the detailed description to follow.

BRIEF DESCRIPTION OF THE DRAWINGS

There follows a detailed description of preferred embodiments of the present invention, which are to be taken together with the accompanying drawings, wherein.

DETAILED DESCRIPTION OF THE PREFERRED EMBODIMENTS

Referring now to the figures, like elements are represented by like numerals throughout the several views.

Figure 1:
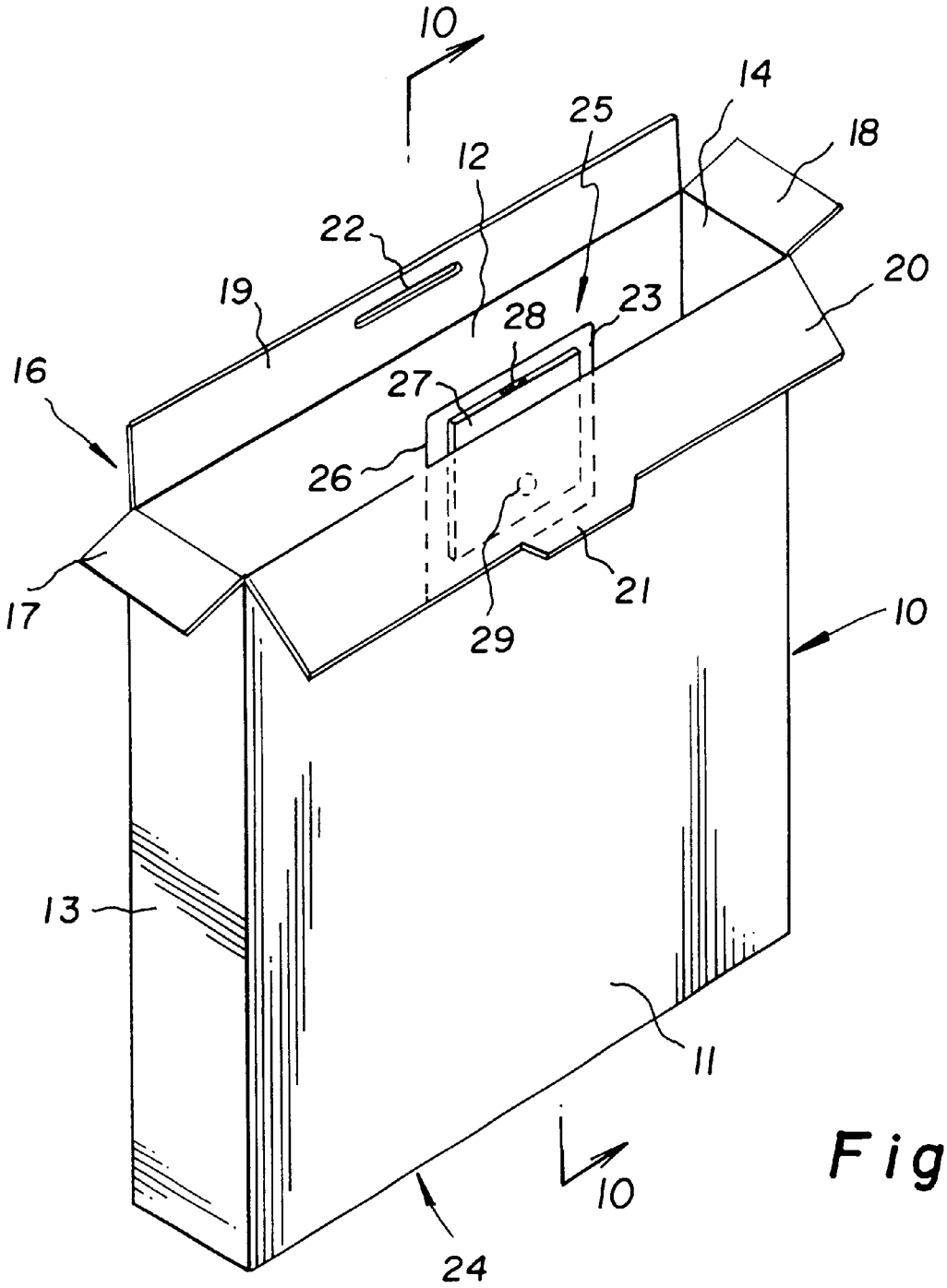
FIG. 1 is a front perspective view of a first embodiment of the invention wherein the container is rectangular.
Figure 2:
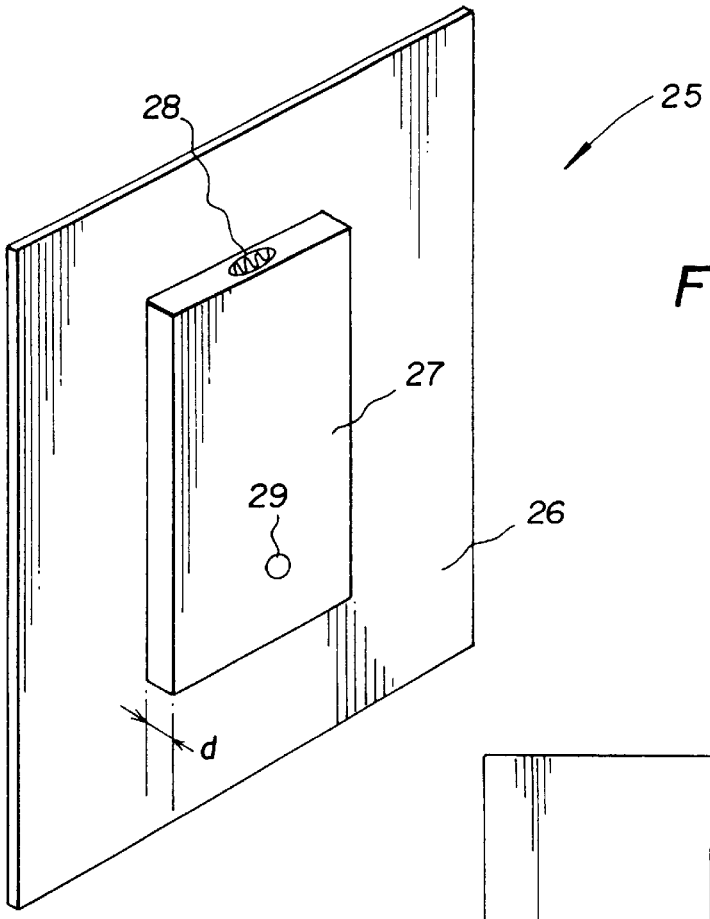
FIG. 2 is a perspective view of the sound assembly utilized in the embodiment of FIG. 1.
Figure 3:
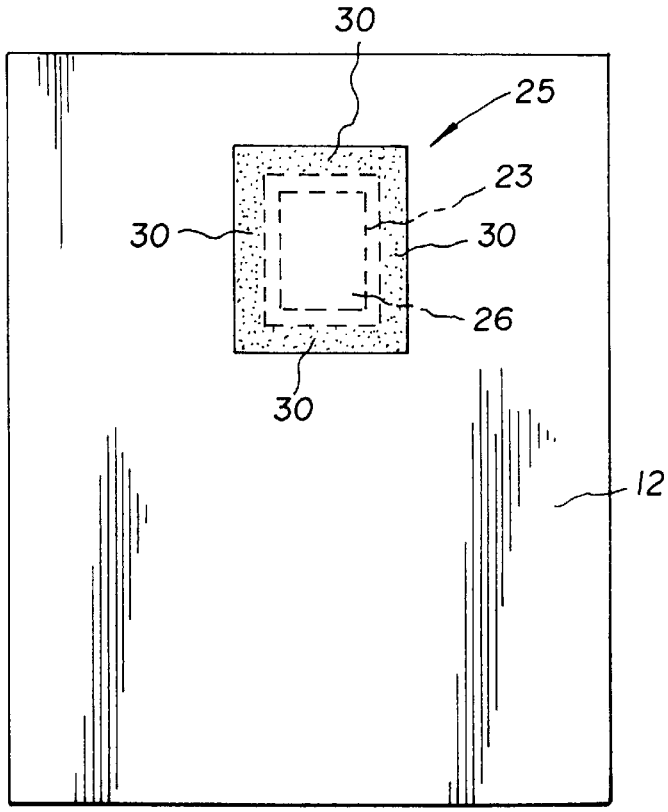
FIG. 3 is a side elevational view showing the exterior wall of the container of FIG. 1 with the sound assembly mounted thereon.

FIG. 1 shows a rectangular-shaped container 10 of the type normally used for cereal or the like which includes the features of the present invention. The container 10 is a conventional-type cereal container having a front wall 11, a rear wall 12, and side walls 13 and 14. The container is formed with an openable access passageway for the removal of contents from the package, which, in FIG. 1 is a conventional top 16 having a pair of short flaps 17 and 18 and long flaps 19 and 20. For purposes of closing the flaps after the box has initially been opened, there is provided a conventional notch 21 on flap 20 which engages in slot 22 formed in flap 19. Referring now generally to FIGS. 1–3, the features of the present invention include a sound assembly 25 which includes a mounting member 26 having a sound chip 27 attached thereto. The sound chip includes a light sensor 28 at the top thereof and a speaker 29.

Referring now to FIGS. 1–3, the rear wall 12 of the container includes an opening 23 which is larger than the outer dimensions of the sound chip 27 but smaller than the outer dimensions of the mounting member 26. Thus, in practice, the opening 23 is first formed in the container and at some point in the manufacturing process the mounting member is adhered to the outside of the rear wall 12 with the sound assembly within the package and projecting inwardly therefrom.

In the embodiment of FIG. 1, the rectangular-shaped container would usually be a cereal box, the cereal itself typically being contained in a plastic or paper bag within the container and therefore not directly contacting the interior wall of the container or the sound assembly 25. The container 10 may be constructed of any suitable material, typically multi-ply paperboard or cardboard. This light sensor is powered by a battery or other energy source. While other devices may be utilized for purposes of activating the sound chip 27, it is preferable to use the light sensor so that it can be activated upon opening the top end 16 by the passage of light into the interior of the container 10.

The sound chip 27 is typically attached to the mounting member 26 by adhesive, including a two-sided adhesive strip or other attachment means. Since the sound chip 27 extends into the interior of the container 10, it should be relatively shallow in depth so as not to impede removal of product from the interior of the container 10.

Figure 4:
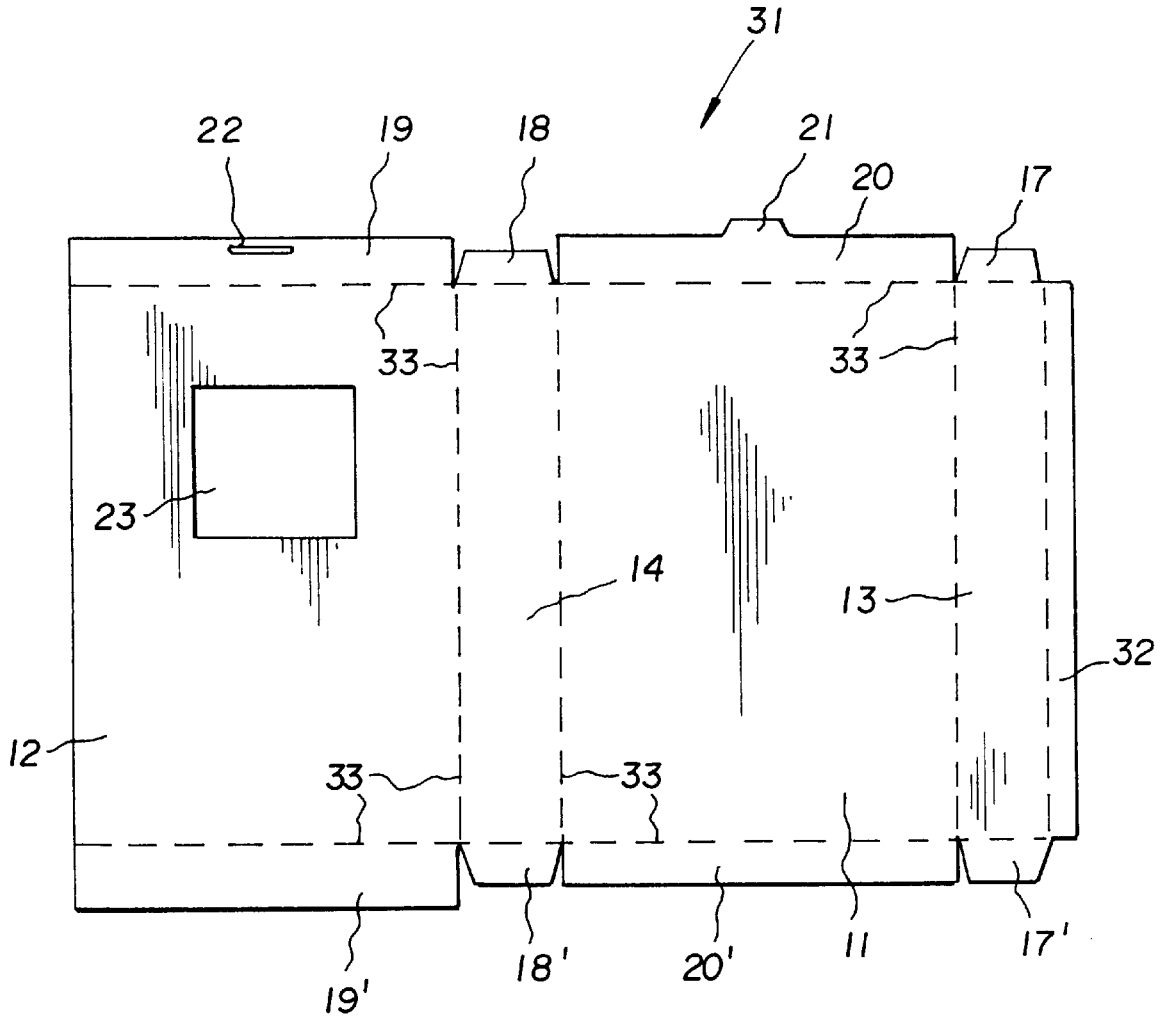
FIG. 4 illustrates a flat blank used to make the container shown in FIG. 1.

FIG. 4 shows a blank 31 used to form container 10. The dashed lines 33 indicate where the blank 31 is scored to be folded to form the container 10. Edge 32 is positioned under rear exterior wall 12 and glued thereto. Bottom flaps 17' 18', 19' and 20' are sealed together by adhesive or other means to form a closed bottom end 24. The top end 16 of container 10 is closed by folding down flaps 17 and 18 inwardly so that they are essentially perpendicular to ends 13 and 14, respectively. Flap 19 is then folded downward and inwardly perpendicular to rear face 12 and flap 20 is folded over flap 19 and glued thereto. After the package has been initially opened, notch 21 is inserted into slot 22 to reclose the top end 16 of container 10.

Figure 5:
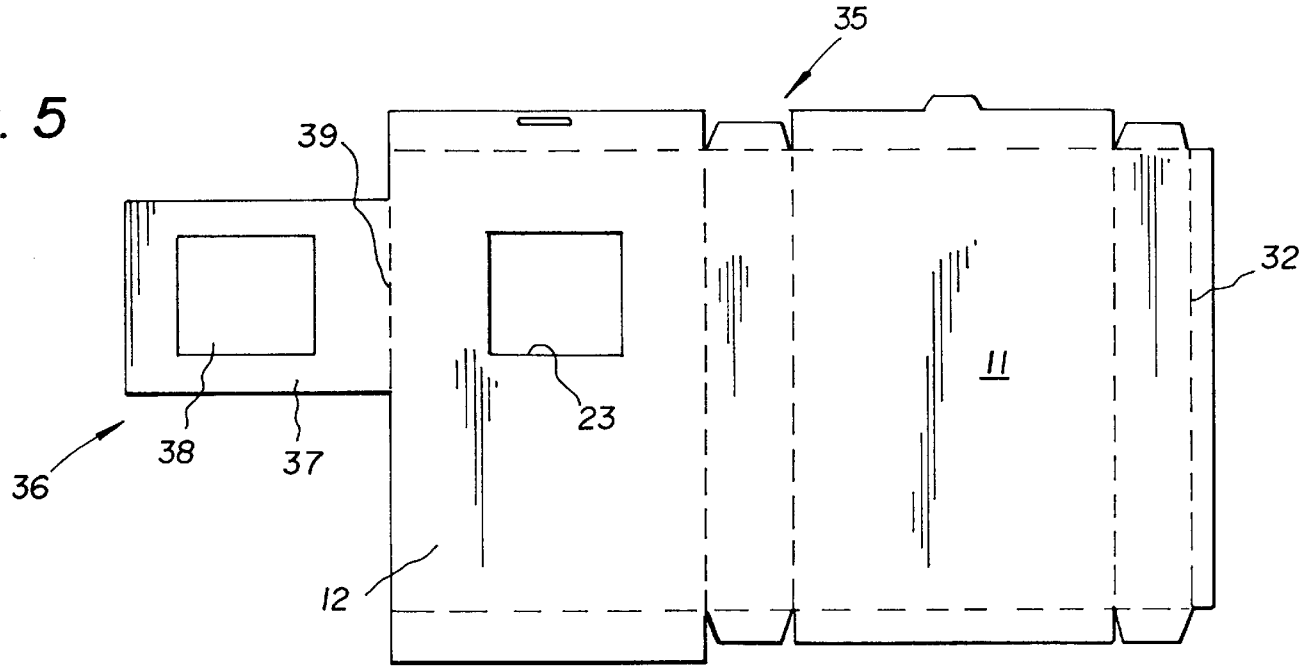
FIG. 5 illustrates a flat blank similar to FIG. 4 but showing a modification thereof.

The opening 23 in the rear exterior wall 12 may be formed in the blank 31 before or after assembly of container 10. As shown in FIG. 3, the opening 23 in rear wall 12 must be of sufficient size to receive the sound chip 27 of sound assembly 25, yet small enough that mounting member 26 completely seals opening 23. Sound chip 27 is inserted so as to extend into the interior of the assembled container 10. The sound assembly 25 can be mounted either before or after the blank 31 is assembled to form a container 10. Typically, mounting member 26 is sealed to the exterior of rear wall 12 around the perimeter, i.e., in the peripheral areas 30 as shown in FIG. 5, by an adhesive or adhesive tape, so as to completely seal opening 23. A complete seal is necessary to ensure that no light passes into opening 23 causing premature activation of sound chip 27.

FIG. 5 shows the embodiment of FIGS. 1–4 with the modification that sound assembly 36 includes a mounting member in the form of a flap 37 attached to rear wall 12 at score line 39. Element 38 represents a sound chip (or in a blank this represents just the area where a sound chip would be located), the sound chip or area 38 being so positioned and so sized on the flap mounting member 37 that when this flap is folded about the score line 39, this area 38 fits into the opening 23. After this fold is made with a sound chip in the area of 38 now located within opening 33, the flap 37 is adhered to the exterior of the rear wall 12 by any suitable means such as an adhesive or adhesive tape.

Figure 6:
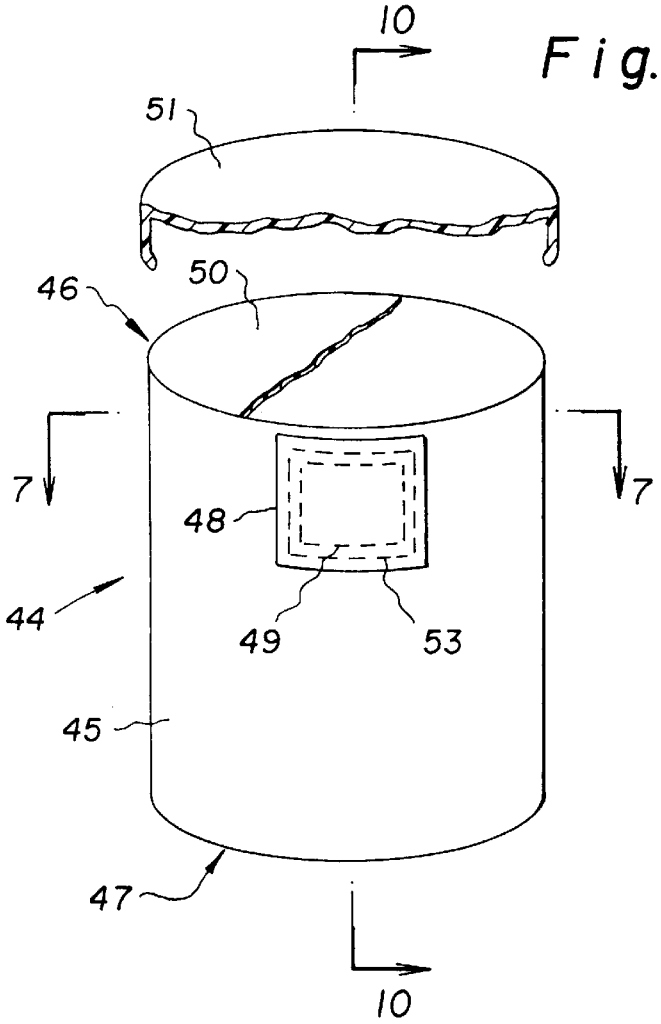
FIG. 6 is a perspective view, partially exploded and partially in section, showing the invention on a cylindrical-type container.
Figure 7:
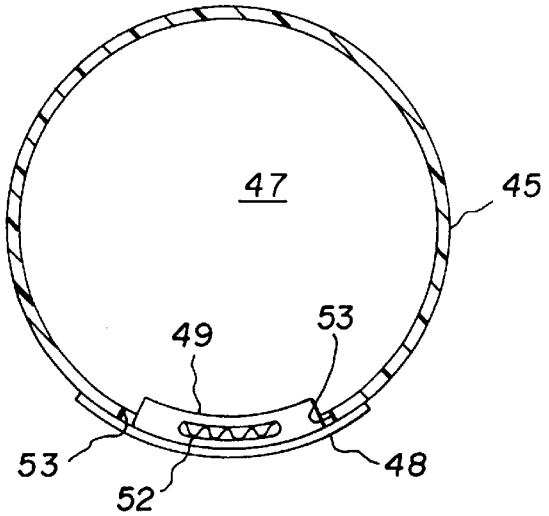
FIG. 7 is a cross-sectional view taken along line 7—7 of FIG. 6.

Although the embodiments of FIGS. 1–5 illustrate a rectangular container, the features of the present invention may be utilized for containers of any size or shape. Illustrative of another type of container which may utilize the features of the present invention would be a cylindrical container as shown at 44 in FIGS. 6 and 7. Such a container may be used for many products including, for example, cereal of a type which is to be heated, stuffing mixtures, potato chips, and the like. This type of container generally includes a cylindrical side wall as shown as 45, an openable top 46, and a closed bottom 47. The contents of this container are generally sealed by means of an opaque air tight sealing membrane 50. These containers often include an easily removable snap on plastic cap 51. This cap is not air tight to the extent that membrane 50 is air tight. It is snapped onto the container as the product is sold. Then, after the container is opened and the air tight membrane 50 is removed, the plastic cap 51 acts as a suitable covering for the partial contents within the container 44 after the initial opening thereof. Referring to FIGS. 6 and 7, the present invention includes a sound assembly which is identical to that described with respect to FIGS. 1–5 except that it is curved in order to fit the curved container 44. This embodiment includes the curved mounting member 48 having a curved sound chip 49 attached thereto. Light sensor 52 is located at the top of the sound chip 49. As in the embodiment of FIGS. 1–5, the opening 53 is large enough for the sound chip 49 to project from the exterior of the container into the container with the periphery of the mounting member 48 adhered to the outside of the wall 45 of container 44.

In this type of container, the contents are usually located loosely in the interior of the container, i.e., not in a separate bag. In this case the contents will be directly up against the sound chip 49. It is more important in such a container with loose contents that the sound chip be positioned high enough in the container that the light sensor 52 will be very close to the opaque membrane 50 to assure that it is activated by light when the opaque membrane is opened. Also, to assure that the sound projects out of the package, it would be preferable to locate the speaker at or near the top of the sound chip.

Figure 8:
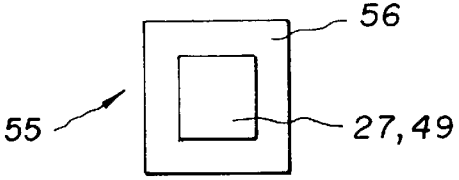
FIG. 8 shows another embodiment of a sound assembly.

FIG. 8 shows an alternative embodiment 55 of the sound assembly wherein one-sided adhesive tape 56 is used as the mounting member. The sound chip 27, 49 is directly attached to the adhesive side of the tape 56.

Figure 9:
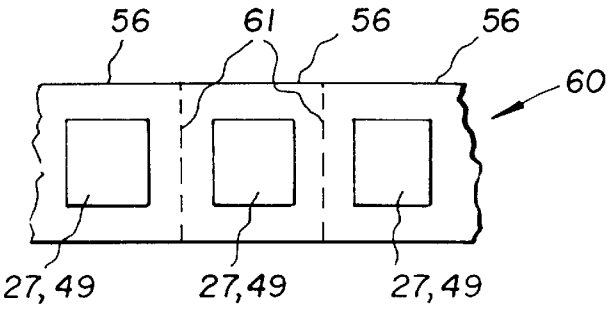
FIG. 9 illustrates a series of sound assemblies of FIG. 8, mounted on a roll.

Referring to FIG. 9, for ease of manufacture, sound chips 27, 49 may be directly attached to a roll 60 of mounting members, and separated prior to mounting the sound assembly 56 to the container 10 or 44. The dashed lines 61 in FIG. 9 indicate where the mounting tape 60 is to be cut. The portion of the mounting tape 60 around the sound chip 27, 49 adheres directly to the exterior walls of container 10, 45 and forms a complete seal around openings 23, 53.

Figure 10:
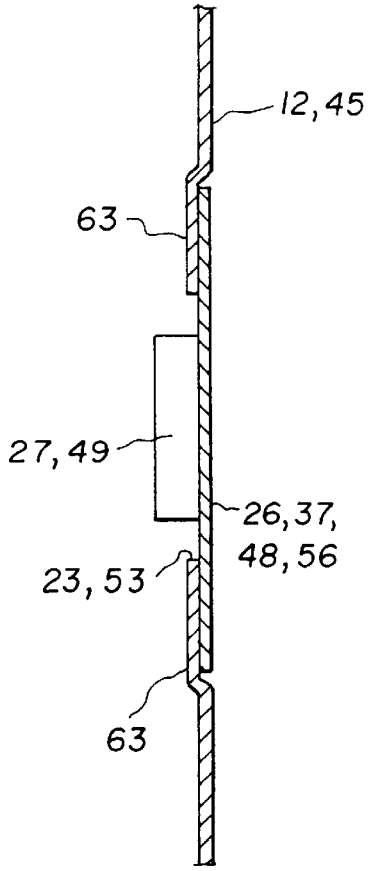
FIG. 10 is a partial sectional view taken along line 10—10 of both FIG. 1 and FIG. 6, but showing a modification thereof.

FIG. 10 illustrates a modification of the invention which is usable with either of the containers 10 or 44. As shown therein, the area around the periphery of the openings 23, 53 is recessed as shown at 63 so that the mounting member 26, 48 or 56 will lie flush with the wall 12 or 45 of its container.

Preferably, mounting member 26, 37, 48 or 56, once in place on rear exterior wall 12, 45, through the use of graphics and/or placement, is essentially imperceptible from the remainder of rear exterior wall. Thus, these mounting members are typically constructed of a similar material to its container, and/or its exterior wall and the mounting members may be covered with indicia which minimizes the ability to easily perceive the outer edges of the mounting member. Of course, while it is indicated that the mounting members are mounted on the rear exterior wall of the rectangular package, they may also be mounted on the wall designed as the front exterior wall 24, or even the side walls 13, 14 of the container 10.

The rectangular container 10 of the invention is easily manufactured utilizing a conventional package, with the only required modification, aside from the optional addition of flap 37 of FIG. 5, being the creation of opening 23. Once the opening 23 is cut in rear exterior wall 12 of the blank 31 or 35 or assembled container 10, the sound chip 27, now mounted on a mounting member is inserted through opening 23. The mounting member is then secured to rear exterior wall 12 such that the opening 23 is completely closed.

Although the invention has been described in considerable detail with respect to preferred embodiments thereof, variations and modifications will be apparent to those skilled in the art without departing from the spirit and scope of the invention as set forth in the claims.

What is claimed is:

1. A container comprising a sound assembly comprising a mounting member having an inner surface and an outer surface and a sound chip mounted on said inner surface, said container having an openable access passageway for removal of contents from the container and walls having an exterior surface and forming an interior for holding a product, an opening formed in a wall thereof, said opening having dimensions such that said mounting member is capable of completely covering said opening and said sound chip is insertable through said opening when mounted on said mounting member, said sound assembly being mounted on the wall of said container such that said sound chip is positioned in the interior of said container and said inner surface of said mounting member is adjacent to an exterior wall surface, said mounting member being secured to said exterior wall surface.

2. The container according to claim 1 wherein said sound assembly includes activation means for activating said sound chip.

3. The container according to claim 2 wherein activation means comprises a light activated device and said openable access passageway includes an openable end and said sound assembly is positioned near said openable end such that, upon opening said openable end, passage of light into said interior of said container activates said light activation means.

4. The container according to claim 1 wherein said container comprises a rectangular-shaped box, and wherein said openable access passageway comprises an openable end and closure means for closing said openable end.

5. The container according to claim 1 wherein said container comprises a cylindrical-shaped carton, and wherein said openable access passageway comprises an openable end and closure means for closing said openable end.

6. The container according to claim 1 wherein said mounting member comprises tape.

7. The container according to claim 1 wherein said mounting member comprises a flap formed as part of a blank used for assembling said container.

8. The container according to claim 1 wherein said opening is rectangular shaped.

9. The container according to claim 8 wherein said container includes a boss around said opening, whereby said mounting member is mountable so as to be flush with said exterior wall surface.

10. The container according to claim 8 wherein said mounting member is rectangular shaped and secured to said exterior wall surface by an adhesive.

11. The container according to claim 1 wherein said mounting member is mounted so as to be substantially flush with said exterior wall surface.

12. A method of manufacturing a container comprising:

mounting a sound chip on a mounting member;

creating an opening in a wall of a blank shaped to form the container or an assembled container, which container has an openable access passageway separate from said wall, said wall having an interior surface and an exterior surface, said opening having dimensions such that said mounting member is capable of completely covering said opening and said sound chip is insertable through said opening;

inserting said sound chip through said opening such that said sound chip extends inwardly relative to said interior surface; and securing said mounting member to said exterior surface such that said opening is completely covered.

13. The method according to claim 12 wherein said step of creating comprises cutting a rectangular-shaped section from said wall.

14. The method of claim 12 including providing the mounting members on a roll and separating individual mounting members from the roll.

15. The method according to claim 12 wherein said step of securing comprises adhering said mounting member to said exterior surface to completely seal said opening.

16. A container for a product comprising:

an interior for holding the product and an exterior surface, said container having an openable end and closure means for closing said openable end, said container being formed with an opening in a wall thereof near said open end; and a light-activated sound assembly comprising a mounting member having an inner surface and an outer surface and a sound chip having light-activation means, said sound chip being mounted on said inner surface of said mounting member, said inner surface of said mounting member being secured to the exterior surface of said container such that said mounting member completely covers said opening and said sound chip extends through said opening and into the interior of said box, whereby, when said closure means is opened, light passes into said interior to said light-activation means to activate said sound chip.

17. The container according to claim 16 wherein said mounting member comprises tape.

18. The container according to claim 17, wherein the tape mounting members are provided on a roll of such members.

19. The container according to claim 16 wherein said mounting member comprises a flap formed as part of a blank used for assembling said container.

20. The container according to claim 16 wherein said mounting member is rectangular shaped and secured to said exterior surface by an adhesive.

21. The container according to claim 16 wherein said container includes a recessed boss around said opening, whereby said mounting member is mountable so as to be flush with said exterior surface.

* * * * *